US005095998A

United States Patent [19]

Hesse et al.

[11] Patent Number: 5,095,998

[45] Date of Patent: Mar. 17, 1992

[54] RAM BORING MACHINE

[75] Inventors: Alfons Hesse, Lennestadt; Herbert Hupertz, Utting am Ammersee, both of Fed. Rep. of Germany

[73] Assignee: Paul Schmidt

[21] Appl. No.: 550,210

[22] Filed: Jul. 6, 1990

Related U.S. Application Data

[63] Continuation of Ser. No. 357,090, May 25, 1989.

[30] Foreign Application Priority Data

Jul. 29, 1988 [DE] Fed. Rep. of Germany ..... 3825800

[51] Int. Cl.[5] ..... B23B 45/16

[52] U.S. Cl. ..... 173/133; 279/19

[58] Field of Search ..... 173/121, 133, 139, 128, 173/119; 279/19

[56] References Cited

U.S. PATENT DOCUMENTS 1,481,641 1/1924 Jimerson. .
1,525,471 2/1925 Stevens. .
2,181,381 11/1939 Roberts. .
2,889,811 6/1959 Guillemier. .
3,625,295 12/1971 Gunning ..... 173/133 X
4,548,278 10/1985 Gidlund ..... 173/139 X

FOREIGN PATENT DOCUMENTS 2,157,259 11/1972 Fed. Rep. of Germany. .
2,223,143 10/1974 France. .
2,537,176 12/1976 Fed. Rep. of Germany. .
3,124,524 1/1983 Fed. Rep. of Germany. .
283,734 9/1988 Europe. .

*Primary Examiner*—Timothy V. Eley
*Assistant Examiner*—Willmon Fridie
*Attorney, Agent, or Firm*—Toren, McGeady & Associates

[57] ABSTRACT

In a ram boring machine that has a striking piston displaceable in a tubular housing, a displaceably mounted chisel passing through a housing tip has a collar by which it is guided in a bore in the housing that has a front and a rear stop limiting the stroke of the chisel, and has a shank that projects into the working chamber of the striking piston, rebounding blows are avoided by making the length of projection of the shank is smaller than the maximum stroke of the collar between the stops.

2 Claims, 2 Drawing Sheets

RAM BORING MACHINE

This is a continuation application of Ser. No. 07/357,090, filed May 25, 1989.

TECHNICAL FIELD OF THE INVENTION

The invention relates to a ram boring machine that has a striking piston displaceable in a tubular housing, a displaceably mounted chisel passing through a housing tip, has a collar by which it is guided in a bore in the housing that has a front and a rear stop limiting the stroke of the chisel, and has a shank that projects into the working chamber of the striking piston.

BACKGROUND OF THE INVENTION AND PRIOR ART

A ram boring machine having a two-part housing, i.e. having a housing tip screwed into the housing accommodating the striking piston, is known from DE-PS 21 57 259. There the housing tip surrounds a chisel having its front end, in the working or striking direction, formed as a striking tip and having at its other end a collar and a shank or pin, the collar being accommodated by a bore in the front housing. The shank represents the striking face for the associated striking piston and, in the starting position before the working stroke, projects from a ring screwed into the housing with the housing tip. The ring limits the movement of the collar, and thus that of the chisel, counter to the working direction of the striking tip. The movement of the chisel in the working direction is limited by a front stop formed by a shoulder in the bore of the housing tip accommodating the collar. The chisel is supported by the collar and compression springs on the housing tip; the springs move the chisel back after each blow from its front position in the housing tip, in the working direction, to its starting position. Besides the ram boring machine with the two-part housing just described, ram boring machines in which the housing and the housing tip are integral are also known; otherwise there are no significant differences between a two-part and a one-part machine housing.

It has been found, particularly if the known machines are used in soft ground, that rebounding blows cannot be avoided. While in the case of hard ground the chisel and thus its striking tip is not moved forward from its starting position, possibly even against the force of a spring, so far that the collar could reach the shoulder of the housing bore limiting the chisel movement, soft ground in comparison does not give as much resistance. The collar thus strikes the front stop defined by the shoulder of the housing bore and owing to the impact energy of the striking piston the undesired rebounding blows thus occur.

OBJECT OF THE INVENTION

It is an object of the invention to design a ram boring machine of this kind so that said disadvantages, in particular when being used in soft ground, are avoided.

SUMMARY OF THE INVENTION

This object is achieved according to the invention if the length of the projecting part of the shank is smaller than the maximum stroke of the collar between the stops. By this surprisingly simple means, namely making the distance that the shank projects smaller than the maximum stroke of the collar up to its front stop, the operation of both single- and two-part ram boring machines can be improved when being used in soft ground. After the chisel is moved forward, namely by an amount corresponding to the distance that the shank projects, the striking piston, in the case of a ram boring machine having a housing tip screwed into the main housing, strikes the then completely closed end face of the housing tip so that the impact energy is absorbed over a large area. Rebounding blows no longer occur. The front stop is not reached by the striking piston since the collar has only approached the stop by the distance that the shank projects without, however, being able to come up against the front stop.

In one embodiment an internal collar or shoulder integral with the housing forms the rear stop. When, in the case of a ram boring machine comprising two housing parts, i.e. a main housing and a housing tip, the main housing accommodating the striking piston is provided with an internal collar as a fixed part of the housing that limits the starting position of the chisel and defines a rear stop, the striking piston strikes wholly against the internal collar after the chisel has been moved forward by an amount corresponding to the projection of the shank. The impact energy is conveyed immediately via the internal collar to the main housing without putting any stress on the threads of the housing parts that are screwed inside one another.

The internal collar and the front face of the housing tip screwed into the housing preferably limit the housing bore, and a compression spring acting on the collar can advantageously be arranged in a recess in the housing tip. The housing bore accommodating the chisel collar, and at the same time the rear stop surface of the internal collar, can for example be made in a simple manner by turning a recess in the front face of the housing, e.g. the bore can be hollowed out of the solid material. If the length of the threaded section of the housing tip screwed into the front end of the housing bore is made such that the distance from the front surface of the screwed-in housing tip to the collar pressed against the rear stop of the internal collar by the compression spring is larger than the projecting length of the shank, the difference between the projecting length and the stroke of the chisel collar according to the invention is obtained without further measures being required. When using the ram boring machine in soft ground the impact energy of the striking piston is thus transmitted either via the end face of the housing tip or via the internal collar securely attached to the housing.

BRIEF DESCRIPTION OF THE DRAWINGS

The invention will now be explained in more detail with reference to exemplary embodiments shown in the drawings, in which.

DETAILED DESCRIPTION OF PREFERRED EMBODIMENTS OF THE INVENTION

Figure 1:
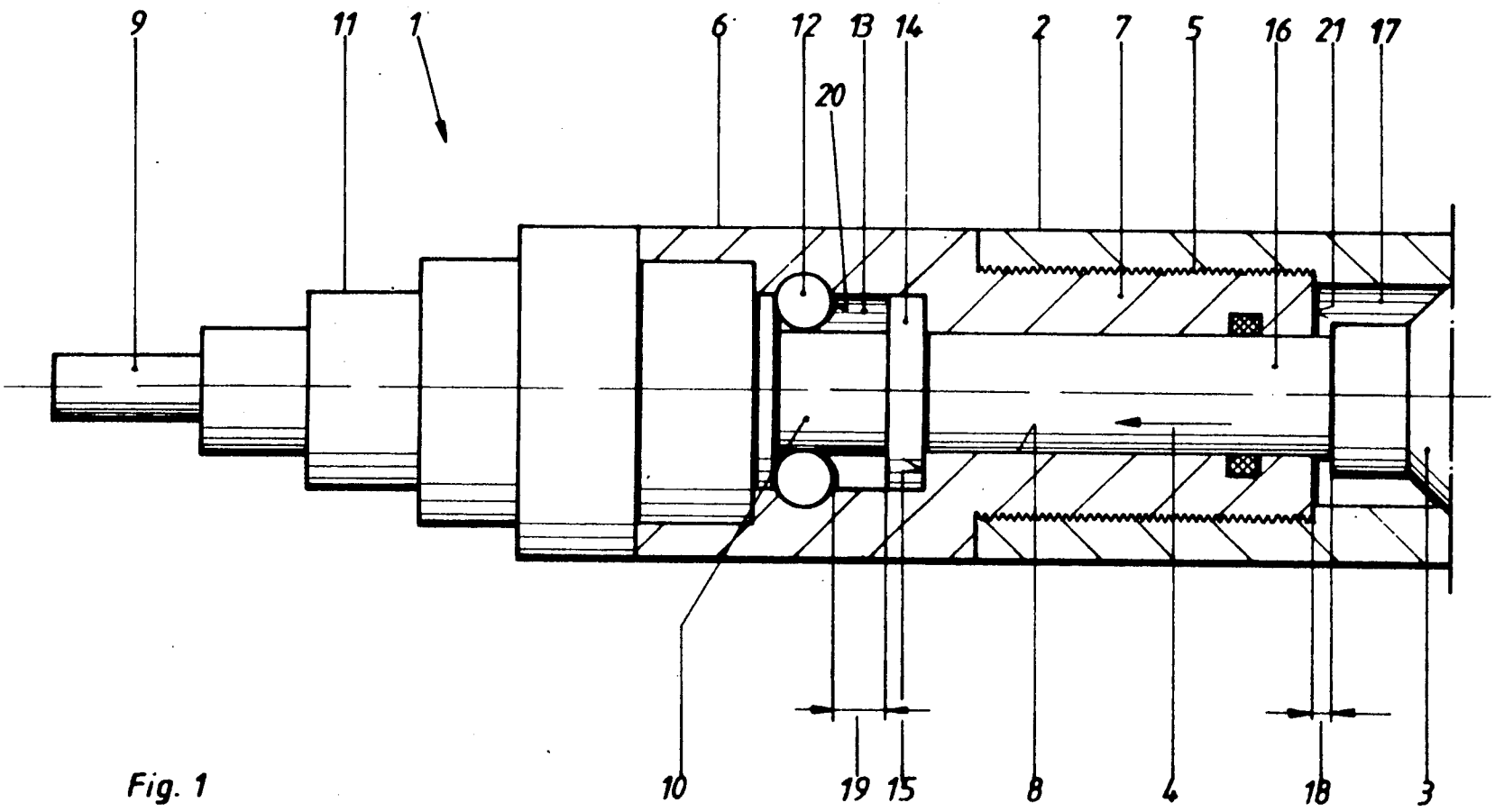
FIG. 1 shows in longitudinal section the front part of a first embodiment of a ram boring machine according to the invention.

Only the front part of a generally tubular housing 2 of a ram boring machine 1 is shown. A striking piston 3, only the front end of which is shown, is guided to reciprocate in the housing 2. The striking piston receives its impact energy from compressed air supplied to the housing 2. Since this involves known means and constructions the rear part of the housing 2 is not shown.

In the ram boring machine 1 the main housing 2 is provided with an internal thread 5 at its front end, in the striking direction 4, into which the pin-like threaded extension 7 of a housing tip 6 is screwed. A chisel 10 shaped at its front end as a striking tip 9 is guided in an axial bore 8 in the housing tip 6. The striking tip 9 is provided with a stepped head 11 which is fastened to the chisel 10 by means of pins 12. The pins 12 pass through a housing bore 13 in the housing tip 6.

In addition a collar 14 on the chisel 10 is arranged in the housing bore 13; in the starting position shown the collar 14 touches the rear stop 15 defined by the housing bore 13. A shank 16 of the chisel 10 extends through the threaded extension 7 of the housing tip 6 and projects into the working chamber 17 of the striking piston 3. The length of projection 18 of the shank 16 is smaller than the maximum stroke 19 of the chisel 10 in the striking direction 4; the stroke 19 is given by the distance which the collar 14 of the chisel could theoretically cover from the rear stop position shown to the pins 12 defining at the same time the front stop 20. Since, however, the length of projection 18 is smaller than the stroke 19, the striking piston 3 strikes the housing tip 6 full on its end face 21 after a stroke of the chisel 10 corresponding to the length of projection 18: the chisel 10 can then no longer move forwards and the collar 14 cannot reach the pins 12 or the front stop 20.

Figure 2:
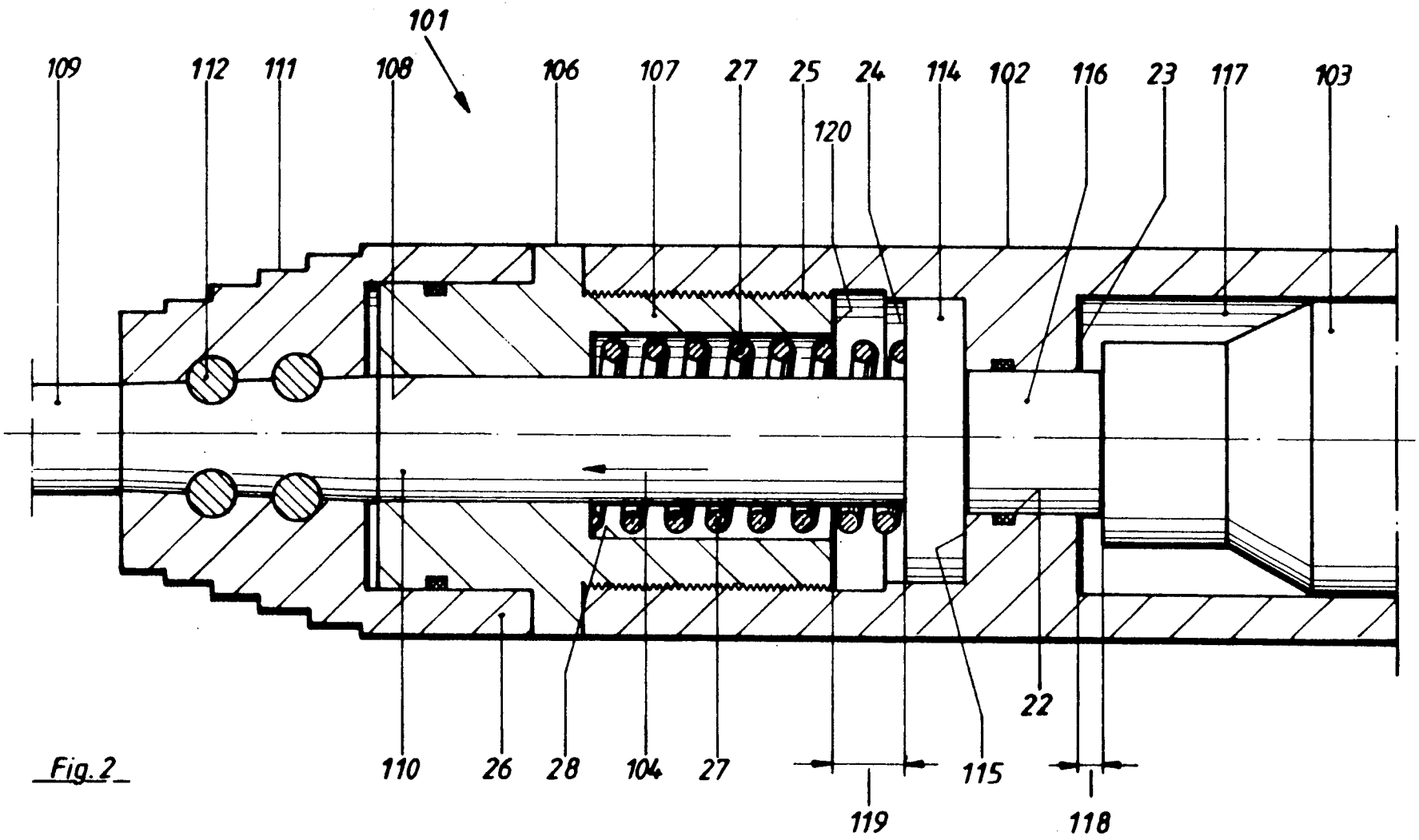
FIG. 2 shows in longitudinal section the front part of a second embodiment of a ram boring machine according to the invention.

As shown in FIG. 2 an internal collar 23, integral with the housing 102 and provided with an axial passage 22, separates a working chamber 117 of the striking piston 103 from a housing bore 24 open at the front in the working or striking direction 104. The housing bore 24 has a front section with an internal thread 25 into which a housing tip 106 is screwed by means of a pin-like threaded extension 107. A chisel 110 formed at its front end as a striking tip 109 is guided in an axial bore 108 in the housing tip 106. A stepped head 111 fastened to the chisel 110 behind the striking tip 109 in the striking direction 104 by means of pins 112 encloses the housing tip 106 with an annular collar 26; the stepped head 111 is displaced relative to the housing tip 106, sliding with the inner surface of the collar on the housing tip 106.

At its end remote from the striking tip 109 the chisel 110 has a collar 114 and a shank 116 passing through the passage 22 in the internal collar 23 and projecting into the working chamber 117 of the striking piston 103. In the starting or end position shown, a compression spring 27 holds the collar 114 against a rear stop 115 defined by the internal collar 23 before the working stroke; the compression spring 27 is arranged in a cylindrical recess 28 in the extension 107 of the housing tip 106 screwed into the housing 102. The length of projection 118, i.e. the amount by which the shank 116 projects from the internal collar 23 into the working chamber 117 of the striking piston 103, is smaller than the maximum stroke 119 of the chisel 110. Owing to the difference between the length of projection 118 and the stroke 119 the striking piston 103 moving the chisel 110 forwards in the striking direction 104 strikes the internal collar 23 after a stroke of the chisel 110 corresponding to the length of projection 118: the collar 23 then forms with the end surface of the shank a flush, sealing striking surface. The impact energy of the striking piston 103 is introduced into the housing 102 via the internal collar 23. The collar 114 has thus approached the front stop 120 defined by the housing tip 106 by the amount corresponding to the length of projection 118 of the shank, but the collar 114 cannot reach the front stop 120.

We claim:

1. A ram boring machine for excavation-less production of earth channels, having a housing tip threaded into a tubular housing, a striking piston displaceable in the tubular housing and actable on a displaceable chisel that passes through the housing tip and has a collar by which it reciprocates and is guided in a bore of said housing that has a fixed front and a fixed rear stop to limit the stroke of the chisel, said chisel having a shank that projects into the working chamber of the striking piston, wherein the length of projection of the shank is smaller than the maximum stroke of the collar between the stops, the housing having an internal collar arranged so as to separate the working chamber from the chisel collar and form the fixed rear stop of the chisel collar, the internal collar having a passage through which the shank of the chisel is movable, the striking piston being actable on the internal collar so as to advance the housing, the housing tip having a recess in which a compression spring is arranged so as to hold the chisel collar against the internal collar.

2. A ram boring machine according to claim 1 wherein the housing bore is bounded by said internal collar and the end face of a housing tip screwed into the housing.

* * * * *

UNITED STATES PATENT AND TRADEMARK OFFICE

CERTIFICATE OF CORRECTION

PATENT NO. : 5,095,998

DATED : 17 March 1992

INVENTOR(S) : Alfons Hesse, et al.

It is certified that error appears in the above-identified patent and that said Letters Patent is hereby corrected as shown below:

On the Title page, item [73] Assignee, please add the following:

-- Paul Schmidt, Lennestadt,
Federal Republic of Germany--.

Signed and Sealed this

Twentieth Day of July, 1993

Attest:

Michael K. Kirk

MICHAEL K. KIRK

Attesting Officer

Acting Commissioner of Patents and Trademarks